US009816205B2

(12) United States Patent
Ke et al.

(10) Patent No.: US 9,816,205 B2
(45) Date of Patent: Nov. 14, 2017

(54) METHOD TO MANUFACTURE COMPOSITE FIBERS OF RICE HUSK AND CHARCOAL

(71) Applicants: Han-Che Ke, Changhua County (TW); Yu-Cheng Ke, Changhua County (TW)

(72) Inventors: Han-Che Ke, Changhua County (TW); Yu-Cheng Ke, Changhua County (TW)

( * ) Notice: Subject to any disclaimer, the term of this patent is extended or adjusted under 35 U.S.C. 154(b) by 62 days.

(21) Appl. No.: 15/147,248

(22) Filed: May 5, 2016

(65) Prior Publication Data

US 2017/0241046 A1 Aug. 24, 2017

(30) Foreign Application Priority Data

Feb. 18, 2016 (TW) ..... 105104818 A

(51) Int. Cl.
*D01F 6/62* (2006.01)
*D01F 1/10* (2006.01)

(52) U.S. Cl.
CPC ..... *D01F 6/62* (2013.01); *D01F 1/10* (2013.01); *D01F 1/106* (2013.01); *D10B 2101/00* (2013.01); *D10B 2201/01* (2013.01); *D10B 2401/16* (2013.01)

(58) Field of Classification Search
CPC ... D01F 6/62; D01F 1/10; D01F 1/106; D10B 2101/00; D10B 2401/16; D10B 2201/01
USPC ..... 524/15
See application file for complete search history.

(56) References Cited

FOREIGN PATENT DOCUMENTS

CN 105017733 A * 11/2015
TW I273114 * 2/2007

OTHER PUBLICATIONS

TW I273114 (2007), machine translation, Taiwan Intellectual Property Office.*
CN 105017733 A (2015), machine translation, EPO espacnet.*

* cited by examiner

*Primary Examiner* — Josephine Chang
(74) *Attorney, Agent, or Firm* — Muncy, Geissler, Olds & Lowe, P.C.

(57) ABSTRACT

A method to manufacture composite fibers of rice husk and charcoal includes the following steps. Heat and grind the rice husk and the charcoal and blend with PET to form first granules and second granules respectively wherein mass fractions of rice husk and charcoal are 15-20 wt %. The mass fraction of rice husk in the first granules and that of the charcoal in the second granules are equal. Blend the first granules and the second granules to form mixed granules. Blend and melt the mixed granules and PET to form a mixture wherein the summation of the mass fractions of rice husk and charcoal in the mixture is 0.2-2 wt %. Form composite fibers from the melted mixture by a procedure of filament making.

5 Claims, 1 Drawing Sheet

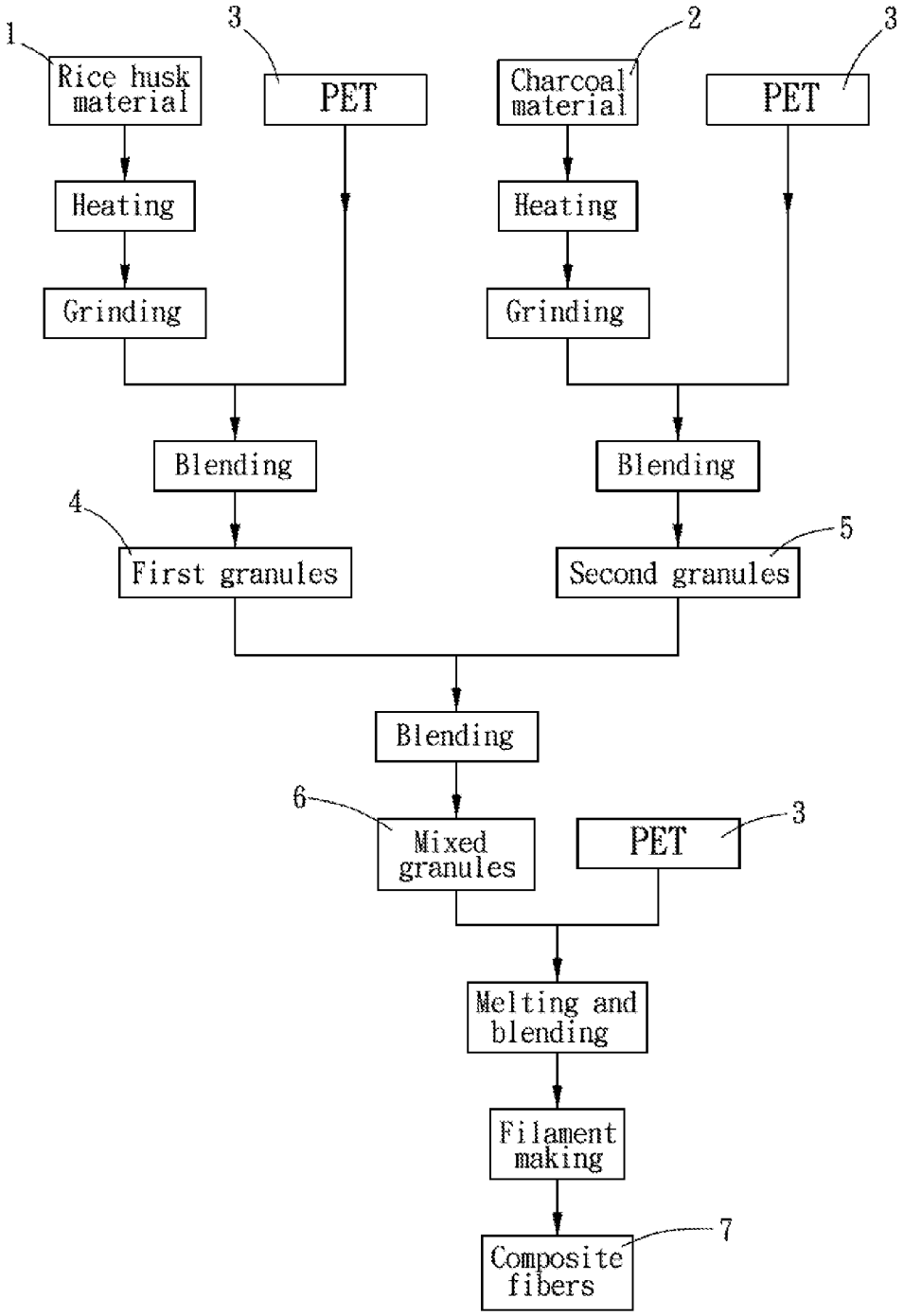
1
Rice husk material
3
PET
2
Charcoal material
3
PET
Heating
Heating
Grinding
Grinding
Blending
Blending
4
First granules
5
Second granules
Blending
6
Mixed granules
PET
3
Melting and blending
Filament making
7
Composite fibers

METHOD TO MANUFACTURE COMPOSITE FIBERS OF RICE HUSK AND CHARCOAL

BACKGROUND OF THE INVENTION

Field of the Invention

The present invention relates to a method to manufacture composite fibers.

Description of the Prior Art

The textile nowadays is often blended with other materials to get extra functions, such as moisture absorption, antibacterial, deodorization, radiation absorption, warming, and etc.

However, the materials utilized to manufacture the composite fibers are mainly metal and chemicals, which are not recycled materials. Besides, different materials are hard to be blended well to be distributed evenly.

SUMMARY OF THE INVENTION

The main object of the present invention is to provide a method to manufacture composite fibers of rice husk and charcoal, which provides functional composite fibers having an appropriate ratio of rice husk and charcoal.

To achieve the above and other objects, the method to manufacture composite fibers of rice husk and charcoal includes the following steps.

Preparing first granules and second granules: heat a rice husk material at 300-800 degrees Celsius and grind the rice husk material. Blend the grinded rice husk material and PET to form first granules wherein the first granules comprise 15-20 wt % of the rice husk material. Heat a charcoal material at 800-1200 degrees Celsius and grind the charcoal material. Blend the grinded charcoal material and PET to form second granules wherein the second granules comprise 15-20 wt % of charcoal material. A mass fraction of rice husk material in the first granules is equal to a mass fraction of charcoal material in the second granules.

Blending the first granules and the second granules: blend the first granules and the second granules to form mixed granules.

Melting and blending: blend the mixed granules and PET and melt a mixture of the mixed granules and PET wherein the summation of mass fractions of the rice husk material and the charcoal material in the mixture is 0.2-2 wt %.

Filament making: form composite fibers from the melted mixture by a procedure of filament making.

Thereby, the composite fibers provided have improved performance.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

The sole FIGURE is a flow chart of the present invention.

DETAILED DESCRIPTION OF THE PREFERRED EMBODIMENTS

Please refer to the FIGURE, the method to manufacture composite fibers of rice husk includes the following steps.

Preparing first granules and second granules: heat a rice husk material 1 at 300-800 degrees Celsius and grind the rice husk material 1. Blend the grinded rice husk material 1 and PET 3 to form first granules 4 wherein the first granules 4 comprise 15-20 wt % of the rice husk material 1. Heat a charcoal material 2 at 800-1200 degrees Celsius and grind the charcoal material 2. Blend the grinded charcoal material 2 and PET 3 to form second granules 5 wherein the second granules 5 comprise 15-20 wt % of charcoal material 2. A mass fraction of rice husk material 1 in the first granules 4 is equal to a mass fraction of charcoal material 2 in the second granules 5. Preferably, the charcoal material 2 is selected from a group composed of binchotan and bamboo charcoal, and the grinded rice husk material 1 and the grinded charcoal material 2 have diameters in nano-scale. In the present embodiment, the rice husk material 1 is heated at 300 degrees Celsius, and the charcoal material 2 is heated at 800 degrees Celsius. Besides, the mass fraction of the rice husk material 1 in the first granules 4 is 15 wt %, and the mass fraction of the charcoal material 2 in the second granules 5 is also 15 wt %.

Blending the first granules and the second granules: blend the first granules 4 and the second granules 5 to form mixed granules 6.

Melting and blending: blend the mixed granules 6 and PET 3 and melt a mixture of the mixed granules 6 and PET 3 wherein the summation of mass fractions of the rice husk material 1 and the charcoal material 2 in the mixture is 0.2-2 wt %. Preferably, the mixed granules 6 and PET 3 are mixed at a mass ratio of 1:9.

Filament making: form composite fibers 7 from the melted mixture by a procedure of filament making. The composite fibers 7 can be utilized to be further weaved.

In conclusion, the two materials are granulated respectively and further blended to be granulated again so that the materials may be distributed evenly. In addition, the improved ratio of materials and PET results that the composite fibers still have good ductility and further has the functions of rice husk and charcoal.

Thus, the composite fibers are advantageous in absorbing radiation and heavy metal, absorbing moisture, deodorizing, providing anions, releasing far infrared, and antistatic.

What is claimed is:

1. A method to manufacture composite fibers of rice husk and charcoal, including:

preparing first granules and second granules: heating a rice husk material at 300-800 degrees Celsius and grinding the rice husk material, to form a grinded rice husk material blending the grinded rice husk material and PET to form first granules wherein the first granules comprise 15-20 wt % of the rice husk material, heating a charcoal material at 800-1200 degrees Celsius and grinding the charcoal material to form a grinded charcoal material, blending the grinded charcoal material and PET to form second granules wherein the second granules comprise 15-20 wt % of charcoal material, a mass fraction of rice husk material in the first granules being equal to a mass fraction of charcoal material in the second granules;

blending the first granules and the second granules: blending the first granules and the second granules to form mixed granules;

melting and blending: blending the mixed granules and PET and melting a mixture of the mixed granules and PET to form a melted mixture wherein the summation of mass fractions of the rice husk material and the charcoal material in the mixture is 0.2-2 wt %; and filament making: forming composite fibers from the melted mixture by a procedure of filament making.

2. The method to manufacture composite fibers of rice husk and charcoal of claim 1, wherein the rice husk material is heated at 300 degrees Celsius, and the charcoal material is heated at 800 degrees Celsius in preparing the first and second granules.

3. The method to manufacture composite fibers of rice husk and charcoal of claim 1, wherein the mass fraction of the rice husk material in the first granules is 15 wt %, the mass fraction of the charcoal material in the second granules is 15 wt %, and the mixed granules and PET are mixed at a mass ratio of 1:9.

4. The method to manufacture composite fibers of rice husk and charcoal of claim 1, wherein the grinded rice husk material and the grinded charcoal material have diameters in nano-scale.

5. The method to manufacture composite fibers of rice husk and charcoal of claim 1, wherein the charcoal material is selected from a group composed of binchotan and bamboo charcoal.

* * * * *